US006684433B2

(12) United States Patent
Giori et al.

(10) Patent No.: US 6,684,433 B2
(45) Date of Patent: Feb. 3, 2004

(54) PRESSURE ADJUSTABLE FOAM SUPPORT APPARATUS

(76) Inventors: Gualtiero G. Giori, 4333 SW. 26$^{th}$ Ct., Cape Coral, FL (US) 33914; Janine Giori, 4333 SW. 26$^{th}$ Ct., Cape Coral, FL (US) 33914

( * ) Notice: Subject to any disclaimer, the term of this patent is extended or adjusted under 35 U.S.C. 154(b) by 0 days.

(21) Appl. No.: 10/163,041

(22) Filed: Jun. 5, 2002

(65) Prior Publication Data

US 2002/0148045 A1 Oct. 17, 2002

Related U.S. Application Data

(63) Continuation-in-part of application No. 10/016,722, filed on Oct. 30, 2001, which is a continuation-in-part of application No. 09/800,752, filed on Mar. 7, 2001, now abandoned.

(51) Int. Cl.$^{7}$ ..... A47C 27/10
(52) U.S. Cl. ..... 5/709; 5/710
(58) Field of Search ..... 5/709, 710, 718, 5/654, 655.3; 297/452.41

(56) References Cited

U.S. PATENT DOCUMENTS 2,779,034 A * 1/1957 Arpin ..... 5/697
3,644,950 A * 2/1972 Lindsay, Jr. ..... 5/709
5,033,133 A * 7/1991 Nissen ..... 5/653
5,325,551 A * 7/1994 Tappel et al. ..... 5/709
5,634,224 A * 6/1997 Gates ..... 5/709
5,680,662 A * 10/1997 Purdy et al. ..... 5/676
5,711,041 A * 1/1998 Chen ..... 5/708

* cited by examiner

*Primary Examiner*—Teri Pham Luu
*Assistant Examiner*—Fredrick Conley
(74) *Attorney, Agent, or Firm*—William E. Noonan

(57) ABSTRACT

A pressure adjustable foam support apparatus includes a resilient, air pressure adjustable, self-inflating foam core. A flexible, airtight cover encloses the core. One or more air passageways are formed through the covering in pneumatic communication with the foam core. Each passageway carries a valve for alternately permitting and blocking passage into and out of the core through the passageway. The valve is opened to exhaust air from and at least partially collapse the core and to allow a core that is at least partially collapsed to draw in air through the passageway and expand. The valve is closed to maintain a selected air pressure within the core whereby corresponding levels of density and firmness (IFD) are exhibited by the core. At least one level of density and firmness provides the core with a viscoelastic or latex foam feel hence greatly reducing pressure points and increasing comfort. A pressure adjustable foam support apparatus that can be made into a mattress, sofa bed, hospital mattress, futon mattress, couch, chaise lounge cushion, mattress topper and other furniture.

18 Claims, 10 Drawing Sheets

PRESSURE ADJUSTABLE FOAM SUPPORT APPARATUS

RELATED APPLICATION

This application is a continuation in part of U.S. patent application Ser. No. 10/016,722 filed Oct. 30, 2001, which is in turn a continuation in part of U.S. patent application Ser. No. 09/800,752 filed Mar. 7, 2001 now abandoned.

FIELD OF THE INVENTION

This invention relates to a pressure adjustable foam support apparatus and to a method of producing a body supporting structure with adjustable levels of density and firmness (IFD) simulating those of viscoelastic foam or latex foam.

BACKGROUND OF THE INVENTION

Recently, high density viscoelastic foam has been used in mattresses, mattress toppers and support pads. This material, which was originally developed for NASA, exhibits a slow recovery time after an external pressure is applied to it. Viscoelastic foam products are intended to conform with the contours of the user's body and provide improved comfort and support. Unfortunately, conventional viscoelastic foam presents a number of disadvantages. Due to its high density (typically in excess of 3 lbs/ft$^3$), this material is quite bulky and heavy. A standard viscoelastic pad typically weighs approximately 3–4 times as much as a comparably sized standard, low density polyurethane foam pad. This makes the high density foam quite difficult and inconvenient to handle, transport and maneuver. The viscoelastic product is also considerably more expensive, about 3–5 times more expensive at the manufacturing level than low density polyurethane foam. Furthermore, conventional viscoelastic foam is not pressure adjustable to meet the individual user's needs, since it's cell structure is so tight that it is difficult to deflate, self-inflate, or pass air through the cells. Moreover, if air is vacuumed from a visco foam core, this foam will typically densify rapidly, and become uncomfortably hard.

Various self-inflating and pressure adjustable foam mattresses have been developed. See for example, Lea et al., U.S. Pat. No. 3,872,525, Nissen, U.S. Pat. No. 5,023,133, Bridgens, U.K. Patent No. 984,604 and my previous U.S. Pat. No. 6,038,722. To date, these devices have been particularly designed for outdoor and recreational use. None of the self-inflating mattresses or cushions are suitable for use in conventional indoor, bedroom or healthcare applications. For example, the Lea product is very thin and employed primarily as a camping mat. It is difficult to successfully adjust the pressure in the Lea mattress or to provide for desired levels of comfort because of the relative thinness of the item. If a user is lays upon the Lea mattress with the valve open, the foam cushion fully deflates almost immediately because the mat is very thin (i.e. 2"–3"). It is very difficult, if not impossible, to adjust the pressure and comfort level in either this or the other known products. A user lying on a mat of this type is simply unable to accomplish this. In fact, to date, self-inflating polyurethane foam mattresses have been utilized in only a fully inflated or fully deflated condition. Intermediate air pressure adjustment has not been exhibited in any of these devices. Nor has pressure adjustment been exhibited to date in any indoor foam mattress, mattress topper or healthcare mattress.

There is a good reason that pressure adjustability has not been a factor to date in the design of self-inflating foam filled mattresses. Pressure adjustability is most important for mats, mattresses, topper pads and healthcare mattresses that are designed for indoor use (e.g. beds, mattress toppers, sofas, sofa beds, hospital beds, furniture, etc.). Such support structures are usually relatively thick in order to provide the needed support and comfort levels desired by most persons. Deflating a thick foam pad according to the teachings of the above cited prior art would require super-human strength, as well as wasted time and effort. This has made the use of self-inflating foam impractical for indoor use to date.

Persons desiring custom pressure adjustment have been limited to the use of air bladder mattresses with the mandatory addition of foam layers or mattress covers superposed on the air bladder's surface to enhance comfort. Sleeping directly on the surface of an air bladder would be very impractical since when fully inflated, it would have sufficient support but feel very hard. Deflated or partially deflated, the bladder would lack the support needed to get a perfect night's sleep. These types of air bladder structures do not employ foam and do not provide the support, comfort and conformance with the body that is provided by traditional foam, visco or latex foam layers. Air bladders typically fail to keep support when they are deflated or partially deflated and the superposed foam layers above the air bladder also lose support, giving the person the illusion that the surface beneath them is changing firmness. Hence, air bladders gain or lose support, whereas foam, when partially deflated, becomes softer due to a decrease in indentation force deflection (IFD). At the same time the foam maintains support due to an increase in density within the foam core. Notwithstanding this, pressure adjustable foam has not been employed previously due, at least partly, to the problems and limitations described above.

SUMMARY OF INVENTION

It is therefore an object of the present invention to provide a foam support apparatus that is conveniently pressure adjustable to achieve comfort and support qualities comparable to those of a viscoelastic or a latex foam product.

It is a further object of this invention to provide a pressure adjustable foam support apparatus utilizing a low density foam which functions comparably to viscoelastic foam, but which is much less expensive, much lighter weight and far easier to handle than any viscoelastic support surface, or conventional box spring mattress.

It is a further object of this invention to provide a foam support apparatus that is more comfortable and versatile than any other standard, non-adjustable, comparable density, foam core mattress, mat or mattress topper existing to date.

It is a further object of this invention to provide a foam support apparatus that is quickly and conveniently pressure adjusted to provide multiple desired levels of density, pressure relief and firmness so that the user's individual comfort and support needs may be satisfied.

It is a further object of this invention to provide a pressure adjustable foam support apparatus which may be partially or fully inflated/deflated and collapsed in a quick and convenient manner by a single person using very little time, effort and exertion.

It is a further object of this invention to provide a pressure adjustable foam support apparatus that is quick, convenient and virtually effortless to assemble, disassemble, transport and store.

It is a further object of this invention to provide a pressure adjustable foam support apparatus that is airtight, impervious to gasses and fluids and which may be washed, pressure cleaned, or directly immersed in water.

It is a further object of this invention to provide a pressure adjustable foam support apparatus that, in certain embodiments is conveniently foldable in distinct sections so that said apparatus may be raised or reclined, as needed and the separate sections may be pressure adjusted utilizing the technology contained herein.

It is a further object of this invention to provide a pressure adjustable foam support apparatus that continuously and sequentially adjusts the pressure within various sections of the mattress so that prolonged engagement of the mattress with the skin and resulting bed sores are avoided.

This invention results from a realization that a relatively low density self-inflating polyurethane foam may be pressure adjusted so that it exhibits a density and firmness comparable to a much more expensive, heavier and non-adjustable viscoelastic or latex foam product. In particular, air is exhausted from or added to the low density foam such that the cellular structure of the foam is modified from its original cellular configuration. By decreasing the volume within the core and, hence, drawing together the cellular structure, this agglomeration of cells increases in density (support) and the firmness (softness/hardness) or indentation force deflection (IFD) of said polyurethane foam is greatly reduced such that these values are equivalent to and provide a consistency, texture and a sensation of touch similar to those of a non-adjustable viscoelastic foam or latex product. A much less expensive, lightweight, versatile, more comfortable and easy to manipulate product is thereby achieved. Nonetheless, the adjustable foam product exhibits advantages and qualities which are comparable to those of the viscoelastic or latex product and is far superior in comfort to comparable low density, non adjustable, foam support devices.

This invention features a pressure adjustable foam support apparatus including a resilient, air pressure adjustable, self-inflating polyurethane foam core and a flexible, airtight cover that encloses the core. One or more air passageways are formed through the covering in pneumatic communication with the foam core. Each passageway carries a valve for alternately permitting and blocking passage of air into and out of the core through the passageway. The valve or valves are opened to at least partially collapse the core and to allow a core that is at least partially collapsed to draw in air through the one or more passageways and expand. The valve or valves are closed to maintain a selected air pressure within the core whereby corresponding levels of density (support) and firmness (comfort) are exhibited by the core.

In a preferred embodiment, the apparatus further includes a vacuum pump or alternating pump communicably engagable with the passageway such that opening the valve engaging the pump with the associated passageway, and operating the pump exhausts air from the core through the open valve and associated passageway to at least partially collapse the core. The passageway may include a first pipe portion disposed within the covering and a second pipe portion attached communicably to and extending transversely to the first pipe portion. The second pipe portion may extend through and be pneumatically communicable with air exteriorly of the covering.

The purpose of said pipe or extended valve structure is to distance the valve and the outer cover from the foam core thereby allowing maximum airflow through the passageway and into the core. It also hinders the foam or inner surface of the outer cover from being drawn into the valve or passageway while the vacuum is evacuating the foam core.

Conversely, conventional and existing foam support structures such as camping mats, would never require the pipe or extended valve disclosed herein. Due to their relative thinness, known foam mats are collapsed and deflated by rolling and/or folding the structure and exerting pressure longitudinally toward the valve and exterior passageway. Air is not drawn out of the core, but instead is pushed out from within the core so the interior surface of the outer cover is not drawn towards the valve and passageway and does not cause a potential occlusion or choking of said passageway.

Another purpose of the pipe mechanism or extended valve feature exhibited herein, is that the mechanism aids in accelerating the self-inflating process of said support apparatus. In order to achieve a rapidly inflated or partially erect product it is desirable for the core to inhale air at a rapid and constant flow. Due to the core's relative thickness, size and the aggressive suction power exhibited when the exterior valve is opened, the inflating foam layer, segment or component attempts to attract the inner surface of the outer cover extending laterally adjacent to the valve. Because the pipe or extended valve mechanism has a relative transverse and longitudinal thickness, the pipe serves as a spacer and prevents the inner surface of the outer cover from touching the foam components during the self-inflation process. This means there is a space between the inner cover and the foam where air may flow freely.

The pipe or extended valve mechanism may be hard or in other configurations hard and spring-like, and may be the same size or larger than the inner end of the valve. This mechanism may be interengaged within the foam core or located adjacent to the foam core and valve. The pipe may be attached permanently or separably to the back of valve.

A baffle may be disposed adjacent to the passageway and intermediate the foam core and the covering to restrict the covering from being sucked into the passageway by operation of the vacuum pump. The foam core may include one or more interengaged foam layers, segments or components disposed adjacently within the covering.

Within the covering may be attached one or more flexible plastic partitions extending laterally or longitudinally and arranged upright or in planar configuration. These partitions form individual and separate inner partitioned chambers within the covering. Those chambers accommodate respective foam pieces, which are introduced at manufacture. Each foam component may include a respective density and indentation force deflection (IFD) that may or not be different from those of the other foam core. The pump may be attached to the passageway exteriorly of the covering. Alternatively, the pump may be attached to the passageway(s) interiorly of the covering. A vacuum pump may be utilized.

Preferably, the foam core includes a polyurethane foam and the foam core includes one or several foam layers, segments, components arranged in one or several directions within the outer cover. The foam has a density of 1–2.5 pounds per cubic foot and an indentation force deflection of 18 to 65 in a full inflated condition or in its original cellular configuration. Preferably, the core is collapsible to a degree such that it exhibits a density of at least 3 lbs/ft$^3$ and an indentation force deflection of less than 15. The core may include an original cellular structure in a fully inflated condition and a modified cellular structure in the partially collapsed condition, which modified cellular structure is caused by subatmospheric air pressure in at least a section of the foam core. Each level of increased or decreased core pressure or volume exhibits a density (support) and IFD value (firmness) that a person may keep when the desired support and comfort is achieved. The foam core may include one or more interengaged, adjacent, contiguous, superposed, and/or partitioned foam layers, segments or components, which may comprise a planar surface or contain convolute foam patterns. The foam surface may be machined and contain cut-out, concave or convex ribbed surfaces extending laterally and/or longitudinally relative to said body supporting apparatus and disposed within the outer cover. These foam layers, segments or components may be arranged side-by-side longitudinally or laterally. The foam layers, segments or components may be superposed in either laterally or longitudinally extending layers.

This invention also demonstrates how the differing support apparatuses disclosed herein function to meet the users individual comfort needs. Most likely, hospital support apparatuses using the support structure described herein would contain the outer cover. Within and attached to the inner surface of the outer cover may be erect flexible plastic partitions or walls extending transversely, longitudinally, horizontally planar or vertically upright within the outer cover so as to separably partition the foam layers, segments or components. As a result of this, each chamber and the foam therein may be pressure adjusted individually without affecting other separately contained foam layers, segments or components within the outer cover. For example, at home the support apparatus may have two longitudinally extending chambers to enable two persons (or one larger person) to adjust corresponding sides of said support. In a hospital or other indoor setting a mattress may contain laterally extending head, middle body or foot chambers that may be adjusted differently to satisfy diverse medical procedures and patients within the hospital. Alternatively, in a hospital or other indoor setting, a mattress may contain two or more longitudinally extending chambers, which may be controlled by an alternating pump and to offer a wide selection of continuously changing support and firmness levels. Perpetual and ever-changing inner core movement as subtle as it may be, may help in the reduction of pressure ulcers.

One version of this support apparatus features various superposed but distanced chambers wherein top and bottom chambers contain foam and an intermediate chamber contains pressure adjustable air only. The purpose of this embodiment is to raise or lower the core and achieve an adjustable height supporting apparatus that may be contained within the outer cover. The air chamber interposed between the top and bottom foam chambers may be inflated with a double action vacuum which exhausts and blows air. Due to their respective weights the foam chambers stabilize the entire unit and a person may choose the height of said support apparatus by adjusting the air pressure in the internal air chamber. Moreover, each individual foam chamber may be adjusted independently to meet user needs regardless of the height of the support apparatus.

It is also a purpose of this invention to demonstrate how a slow but variable vacuum speed may be desirable to identify and maintain a selected level of density and firmness within the core. Alternatively, a faster variable speed setting may be a desirable and quicker way to evacuate the supporting apparatus. The above variable speed and suction adjustments may be performed with aid of a hand held infra-red remote controller while the person is horizontally juxtaposed on the support apparatus.

Support apparatuses that lack interior dividers within the core meet yet other needs. The foam core may be pressure adjusted simultaneously when the foam layers, segments or components are undivided by plastic layers. Each foam layer, segment or component may include a designated density and indentation force deflection (IFD) that is different from that of the other foam layer(s), segment(s) or component(s). Each foam piece may alternatively have an identical density and IFD.

In an alternative embodiment, the body supporting apparatus may further include either one section or a plurality of longitudinally or laterally juxtaposed and foldably interconnected support sections. Each support section includes a portion of the foam core and a portion of the covering that encloses said foam core portion. The support sections may include a head section that is engaged by the head of a user and a second support section that is foldably attached to and immediately adjacent the head section for supporting a middle of the body. A third foot support section may be foldably attached and immediately adjacent to said second section. These foldably attached sections may be releasably interconnected.

Each support section being releasably interconnected may be assembled in the home using zipper or Velcro™ means to attach these together so as to achieve a foldable and self-inflating support system. Here again, and especially in a healthcare setting, it may be desirable to achieve a raised or reclining head or foot chamber. Since the two or more sections are foldably connected, it is possible to raise and recline each individual section, as well as pressure adjust the individual pieces of the internal foam core to achieve selected support and comfort.

This invention also features a method of producing a pressure adjustable foam support apparatus which includes selected levels of density and firmness. The method includes providing a resilient, air pressure adjustable, self-inflating foam core and enclosing the foam core in a flexible airtight covering. An air passage is provided through the covering in pneumatic communication with the foam core. The passageway carries a valve for alternately permitting or blocking the passage of air into and out of the core through the passageway. The valve is opened to selectively exhaust air from and introduced air into the core through the passageway to adjust the pressure within the core until the core achieves selected levels of density and firmness. The valve may then be closed to maintain the core at the selected levels of density, pressure relief and firmness.

Preferably, the air is exhausted from the core by opening the valve and pumping air from the core outwardly through the passageway. This modifies the cellular structure of the core. The foam core may initially include a density of 1–2.5 pounds per cubic foot and an IFD of 18–65 in a fully inflated condition. The core is partially collapsed by a vacuum pump engaged with the passageway until a density of at least 3 $lbs/ft^3$ and an IFD of below 15 is achieved. As a result, the low density foam core simulates the feel of a high density viscoelastic or latex foam component.

Air pressure may be adjusted sequentially and continuously in a plurality of partitioned foam pieces in the support apparatus. Each piece may be communicably connected through a respective solenoid valve to a vacuum pump that pulls air sequentially through the valve to reduce the air pressure in the foam piece. The respective pieces are pressure adjusted in this manner, in sequence, to generate space between the mattress and the skin. This helps to prevent the formation of skin ulcers and bed sores.

DETAILED DESCRIPTION OF PREFERRED EMBODIMENTS

Other objects, features and advantages will occur from the following description of preferred embodiments and the accompanying drawings, in which.

Figure 1:
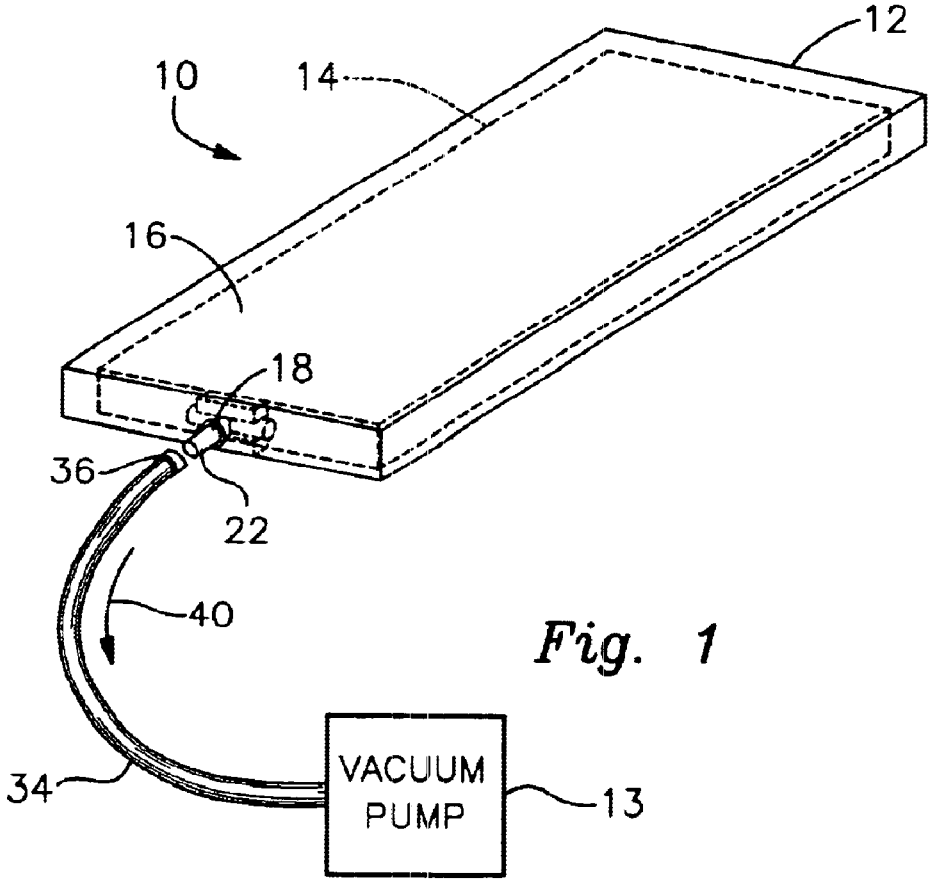
FIG. 1 is a perspective, partly schematic view of a pressure adjustable foam support apparatus according to this invention.

There is shown in FIG. 1 a pressure adjustable foam support apparatus 10 comprising a body supporting component 12 that is releasably and adjustably interengaged with a conventional vacuum pump 13. Body supporting component 12 may comprise a mattress, mat, pad, cushion or virtually any other type of body supporting item. Component 12 is suitable for supporting humans as well as animals. Apparatus 10 is particularly adapted for indoor use although it may be used in a wide variety of indoor and outdoor applications. For example, the body supporting component 12 may be used in conjunction with a piece of furniture or it may serve as a floatation device for a pool.

Component 12 may have assorted sizes and shapes. For example, component 12 may be rectangular as shown. Alternatively, it may include various non-rectangular configurations. The support component may have a size and thickness such that is suitable for use as a mattress, mattress topper, sofa bed, hospital mattress or mat or chair cushion, an exercise mat or a pet cushion. Representative dimensions for the body supporting component, when it is used as a mattress, are as follows:

Twin:74" in length x 39.6" in width x 7" thickness

Full:74" in length x 54.5" in width x 7" thickness

Queen:74" in length x 60.5" in width x 7" thickness

It should be understood that the foregoing dimensions can vary within the score of this invention. For mattress use it is particularly preferred that the structure have a thickness of at least six inches. This allows the support to be pressure adjusted while the user reclines on it. Thinner mattresses possess insufficient cellular foam structure to achieve this benefit.

Figure 2:
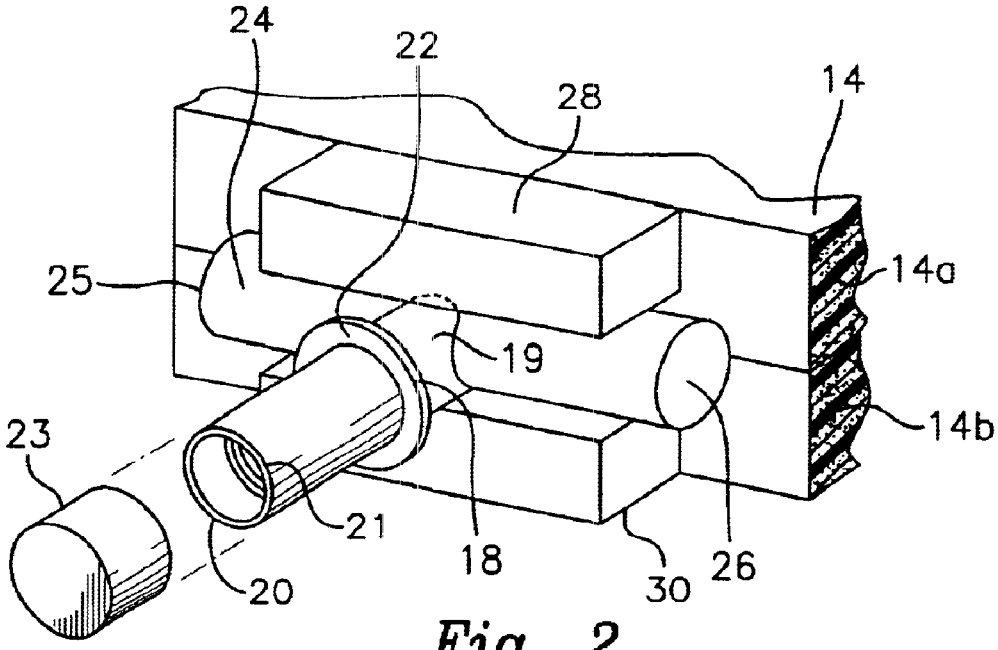
FIG. 2 is a perspective, partly cut away view of a representative air passageway, baffle and foam core of the support apparatus.
Figure 3:
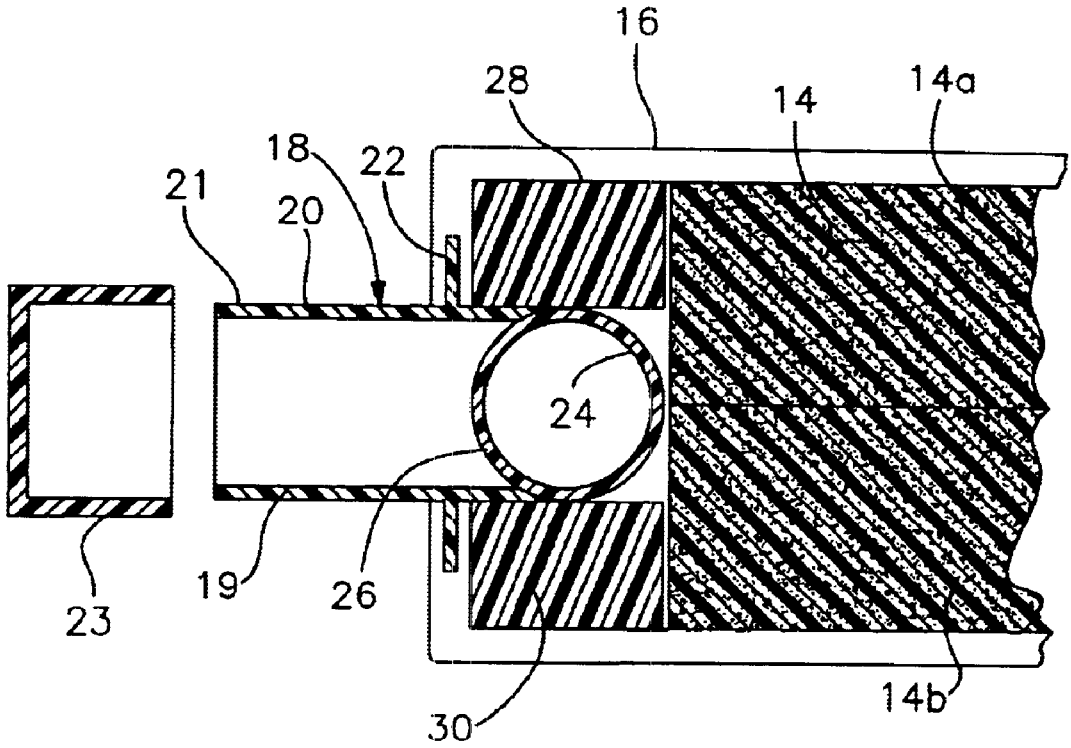
FIG. 3 is an elevational, cross sectional view of the support apparatus and in particular, the foam core, air passageway and an airtight covering.

As shown in FIGS. 1–3, body supporting component 12 comprises an internal foam core 14 disposed in an airtight cover 16. Core 14 preferably features a self-inflatable, resilient open-celled foam composed of polyurethane or a similar material. The core is capable of being alternately filled with or exhausted of air, as required, such that the core is pressure adjustable. Preferably, a low density foam is employed, which exhibits a density of 1–2.5 pounds per cubic foot and an indentation force deflection (IFD) of 18–65 when the foam is in a fully inflated state. A single piece of foam may be used. Alternatively, in certain embodiments, such as shown in FIGS. 2 and 3, foam core 14 may include a plurality of adjacent pieces such as generally planar or ribbed upper and lower segments 14*a* and 14*b*, which may be preferably interlocked in some other suitable manner. In such versions, the respective pieces 14*a* and 14*b* may have different densities and IFD ratings. This permits the user to initially provide component 12 with at least two different comfort, body support levels that may be subsequently adjusted in the manner described below. In alternative embodiments separate foam core segments having different densities and IFD ratings may be arranged side-by-side and extend either laterally or longitudinally within cover 16. These components may be either directly interengaged or separated by one or more dividing walls made of flexible plastic material so that each chamber may be pressure adjusted respectively without affecting other foam components within the core.

Figure 3A:
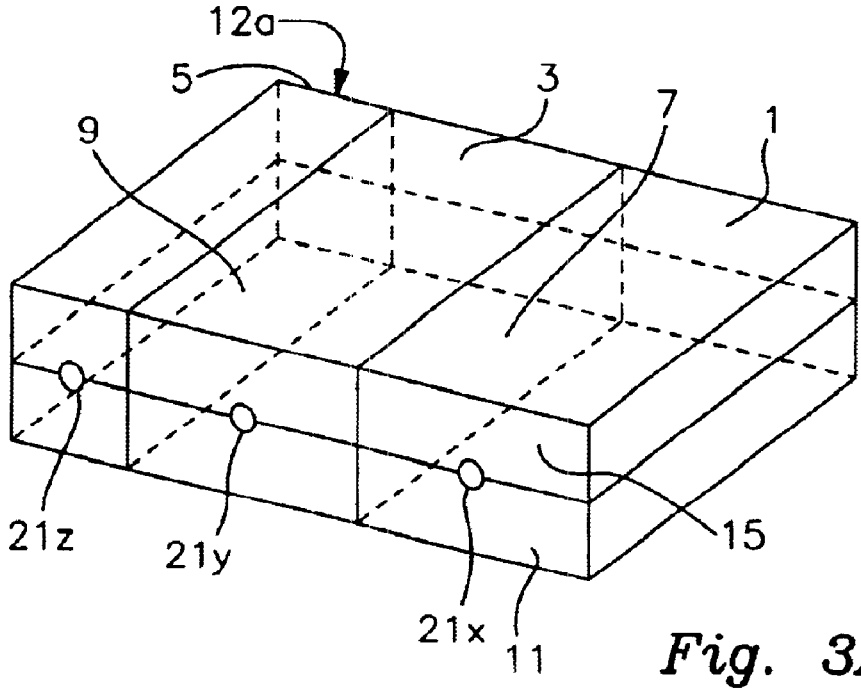
FIG. 3A is a simplified perspective view of a support apparatus having multiple foam components accommodated in transverse partitioned chambers; multiple foam layers are also employed.
Figure 3B:
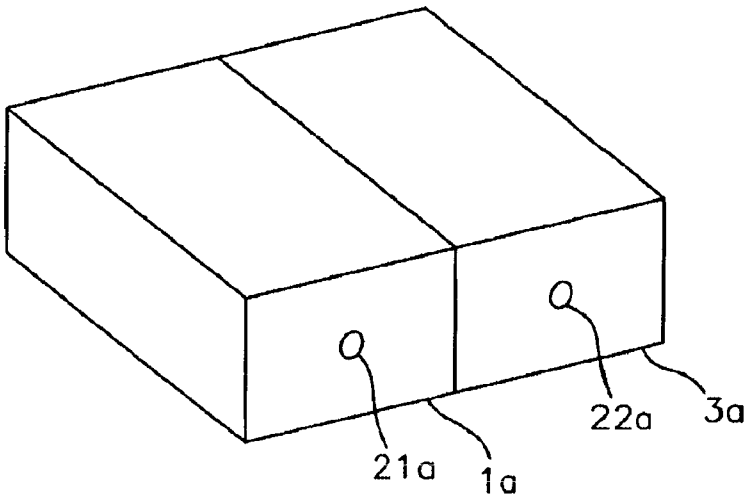
FIG. 3B is a view similar to FIG. 3A of a version employing a pair of longitudinal foam pieces.

The foregoing feature is disclosed more specifically in FIG. 3A. Therein, support component 12*a* is a hospital mattress. Various other support structures are contemplated within the scope of the invention. Support component 12*a* features three transverse foam sections 1, 3 and 5 arranged from head-to-toe within the mattress. Each of the sections extends transversely across the mattress and is received within its own chamber. The chambers are defined by the outer covering (omitted in FIG. 3A) and transverse plastic strips 7 and 9 that are connected internally to the cover by appropriate means of attachment such as heat welding. Each of the foam sections 1, 3 and 5 is received in a respective chamber. Additionally, each of the sections 1, 3 and 5 may itself include one or more layers (e.g. layers 11 and 15), which are respectively stacked within each chamber. The individual foam pieces may have different densities and IFD factors within the scope of this invention. Various numbers and arrangements of chambers and individual foam pieces may be utilized. For example, as shown in FIG. 3B, longitudinal (head to toe) chambers and respective foam pieces 1*a* and 3*a* may be used. Each chamber is again provided with one or more valves 21*a*, 22*a* respectively, which pneumatically communicate with the foam core pieces through the cover (again omitted for clarity). In certain embodiments, the foam pieces may be separate and distinct, but dividers may be omitted. In such cases, the adjacent foam pieces are contiguous.

Utilizing multiple foam core components provides particular benefits in healthcare mattresses. Each foam component may include a respective density and indentation force deflection that is different from that of the other foam component, or may be identical. Various numbers of foam segments having assorted densities may be employed within the scope of this invention. This allows the user to change the firmness and density of the supporting surface, for example, by simply reversing or turning over the support component to expose a surface having a different density and IFD. This is particularly useful in situations where the component is employed as a mattress.

Core 14 is enclosed by flexible sheet-like exterior covering 16, FIGS. 1 and 3. This covering should comprise a durable, airtight and preferably waterproof material such as PVC, nylon polyurethane or other PVC/polyurethane mix of weldable and laminated fabrics. Covering 16 may be constructed in a single piece or multiple inner and outer pieces that are interconnected by sewing or RF welding. The latter technique is especially preferred because it renders the support component essentially airtight, gastight and watertight. This permits component 12 to be used as a float. In the case of a hospital indoor mattress, it is impervious to gases and fluids. An airtight zipper such as the YKK TZNC™ brand may also be utilized to achieve imperviousness. However, due to this zipper's high cost, welding is the most cost effective way to interconnect outer and inner pieces of the outer cover to render them airtight.

One or more passageways and associated valves may be employed by component 12 for the purpose of selectively collapsing (deflating) and expanding (inflating) the foam core. The precise number of passageways and valves used may be varied and does not constitute a limitation of the invention. As shown in FIGS. 1–3, a respective air passageway 18 is formed through outer covering 16 in pneumatic communication with the interior of component 12 and foam core 14. Air passageway 18 comprises a T-pipe 19 composed of PVC or some other type of durable plastic. The passageway includes a first tubular section 20 that extends outwardly through the covering. A second tubular section 24 is attached communicably and perpendicularly to section 18 at the interior end thereof. Tubular section 24 is arranged within component 12 and adjacent to the edge of foam core 14. Section 24 includes openings 25 and 26 formed at opposite ends of the tube section. The tubular section 24 that is adjacent to the foam may be cut laterally leaving a laterally extending opening that increases air flow to and from the core. The entire T-pipe typically comprises a unitary piece although multiple interconnected segments may be used. Section 24 may be attached to section 20 at other than a perpendicular angle. A pair of upper and lower baffles 28 and 30 are mounted above and below T-pipe 19 adjacent the ends of foam core 14. These baffles comprise foam blocks that are relatively rigid compared to the self-inflating foam of core 14. They help to keep covering 12 separated sufficiently from core 14 so that the covering is not sucked into the T-pipe passageway 19 during deflation of component 12.

Tubular section 20 carries a plastic valve 21. The valve includes a peripheral flange 22 that engages the inside surface of covering 16. The flange is secured to the covering by RF welding or other means. In FIG. 3 a gap is depicted between the flange and the covering for clarity. A cap or closure 23, may be selectively and sealably interengaged with valve 21 to close the valve. Closure 23 and valve 21 may include complementary circumferential threads that are interengaged to close the valve. Cap 23 is selectively disengaged from tubular valve 21 to open the valve. It should be understood that a variety of known pneumatic valves may be employed within the scope of this invention including drain valves as described in copending U.S. patent application Ser. No. 09/800,752. The valve may also comprise assorted pressure relief valves and spring loaded check valves such as the boat valve manufactured by Halkey-Roberts. Such valves are currently employed in watercraft such as the Zodiac™.

The T-pipe effectively comprises an extension of valve 21. T-pipe 18 and valve 21, are usually made with separate molds and may be designed to be separably interengaged. The valve 21 may also be designed so as to contain a T-pipe extension within one mold.

The distal openings 25 and 26 of tubular section 24 are adjacent but face perpendicularly to foam core 14. The air passageway is spaced sufficiently close to the foam core and is within the airtight covering 12 such that the air passageway and valve 21 carried thereby communicate pneumatically with the open-celled foam core. When the core is squeezed, air from the cells in the core is exhausted through the open valve. Alternatively, when the core is in a collapsed condition, opening the valve (e.g. removing cap 23) causes the air to be drawn inwardly through the open valve and absorbed by the foam core. This causes component 12 to inflate. When cap 23 is engaged with valve 21, the valve is closed so that air is blocked from passing through passageway 18. If the mattress is partially or fully deflated, closing each valve prevents the foam from re-inflating. Alternatively, if the foam is already fully inflated, closing each of the valves allows a person or animal to engage component 12 without deflating the foam core. It should be understood that various versions of this invention may employ multiple valves as described above. Each valve may be associated by a respective foam section (such as valves 21*x*, 21*y* and 21*z* in FIG. 3A). Alternatively, multiple valves may be associated with a single piece of foam. This typically permits faster inflation/deflation of the core. In still other cases, a single valve may cooperate with multiple adjacent but undivided pieces of foam.

Component 12 is depicted in a fully expanded or inflated condition in FIG. 1. In this state, the foam core has absorbed air and the cells of the foam are in their normal, fully inflated condition. As a result, the foam exhibits a low density and, when the valve is closed, the core provides a relatively firm support. Component 12 may also be used in the inflated condition by leaving each valve 21 open so that the weight of the body exerting a downward pressure exhausts small amounts of air from the core. Each valve is then closed. As a result, the foam core remains a little less firm.

Figure 4:
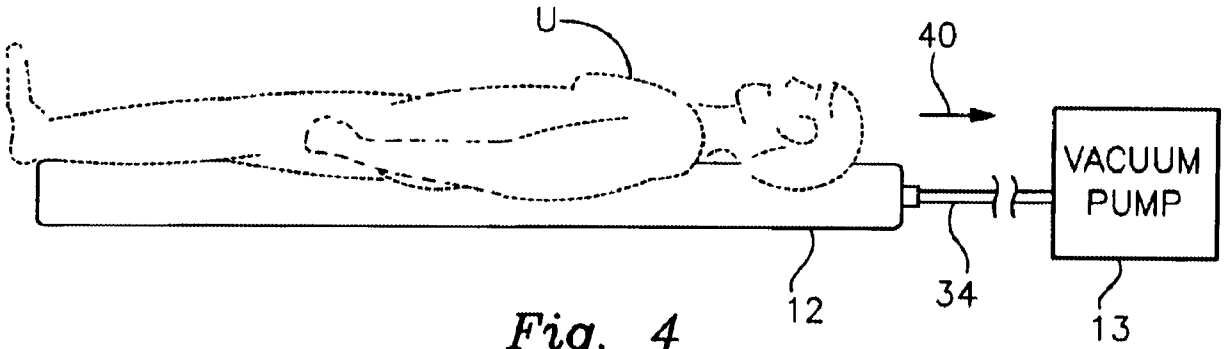
FIG. 4 is an elevational view of a person laying upon the support apparatus.

To adjust the firmness and support of the body supporting component, cap 23 is removed and vacuum assembly 13 is operably interengaged with valve 21. The vacuum assembly comprises a standard vacuum pump 13, which may be a conventional household vacuum pump or an alternative type of vacuum means such as a small handheld vacuum. A hose 34 having a suction inlet or nozzle 36 is operably attached to pump 13. To deflate and adjust the air pressure of foam core 14, nozzle 36 is fit over valve 21 by engaging the nozzle about tubular section 18 such that the distal end of the inlet or nozzle sealably engages the side surface of covering. The operator activates vacuum pump 13, which causes nozzle 36 to seal against the side 56 of component 12. The vacuum draws air from foam core 14 outwardly through the open valve. As air is drawn outwardly from the foam core in the manner indicated by arrow 40 in FIGS. 1 and 3, subatmospheric pressure is created in the core and the cellular structure of the foam core is modified. The density (support) of the core increases while the IFD (firmness) of the foam decreases. The foam core achieves a much desired viscoelastic latex feel wherein a relatively high density of at least 3 $lbs/ft^3$ and a relatively low indentation force deflection value of below 15 are exhibited. As shown in FIG. 4, when component 12 achieves the foregoing parameters, it conforms to the bodily contour of a user and exhibits a supportive, and yet very soft foam resistance. The product exhibits slow recovery to application of an external pressure, which is a feature exhibited by viscoelastic foam products, or even better no recovery whatsoever, indicating the absence of upward pressure. The improved support and comfort achieved by component 12 are comparable to the levels provided by viscoelastic supports that are currently available, yet these benefits are achieved in the present invention by using a low density foam that is much less expensive and lighter weight than the standard viscoelastic or latex foams. Moreover, unlike standard viscoelastic foam, component 12 may be pressure adjusted to the degree required to provide comfort and support levels desired by the user. Even after user U is engaged with component 12, the density and firmness levels may be fine tuned by pumping additional air outwardly from the foam core or, alternatively, by removing the vacuum pump 13 and hose 34 and permitting additional air to be drawn inwardly through the open valve and into the self-inflating foam core. Because component 12 is preferably at least six inches thick, the foam is adjustable while the user remains lying on the support. In thin camping type mattresses, it is impossible to adjust the density and firmness while lying on the mat because there is inadequate foam structure to overcome the weight of the user.

In embodiments employing multiple valves (and either one or multiple foam sections) air pressure with the support may be adjusted through each of the valves as needed. For example, in FIG. 3A, air pressure may be adjusted within sections 1, 3 and 5 by opening, closing and engaging a vacuum with valves 21*s*, 21*y* and 21*z* respectively. A desired density, firmness and support is thereby provided to each section as required.

Component 12 may be fully collapsed by continuing to pump air out of the foam core until core 14 is fully deflated. The support component is now in a substantially flat and easy to manipulate condition. After the foam core is fully deflated, the user disengages nozzle 36 from valve stem 20 and promptly shuts the valve or valves communicating with the core by attaching each cap 23 to its associated stem 20. This prevents the foam core from re-inflating. The user then wraps, folds or rolls up the deflated support component in the manner as shown in U.S. patent application Ser. No. 09/800,752. The user may also wrap, fold or roll the deflating support component as it deflates to save time. As further described therein, the support component 12 may carry a strap that encircles the rolled component to provide for convenient transportation and storage.

Figure 5:
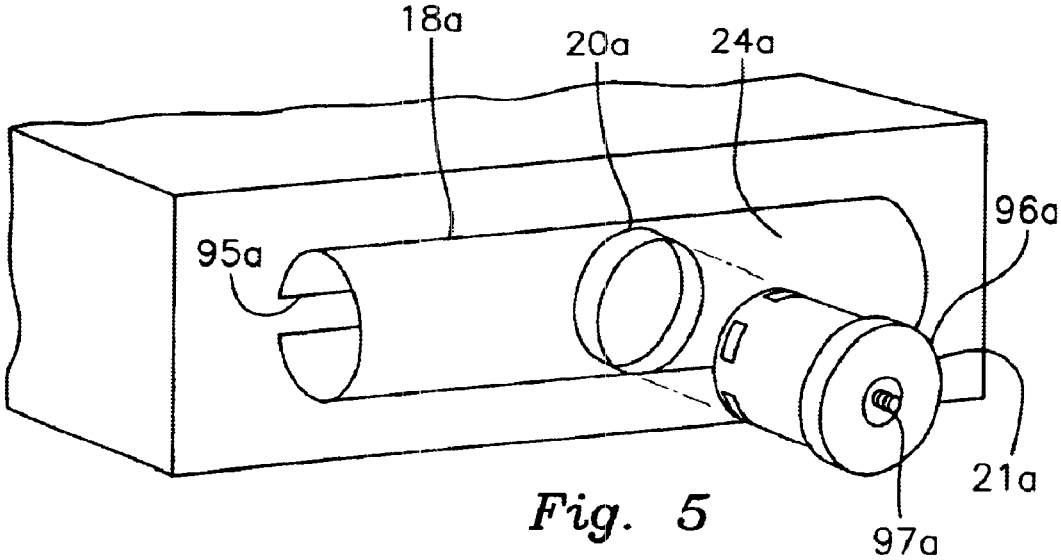
FIG. 5 is a perspective; partly exploded view of an alternative preferred air passageway and valve.
Figure 6:
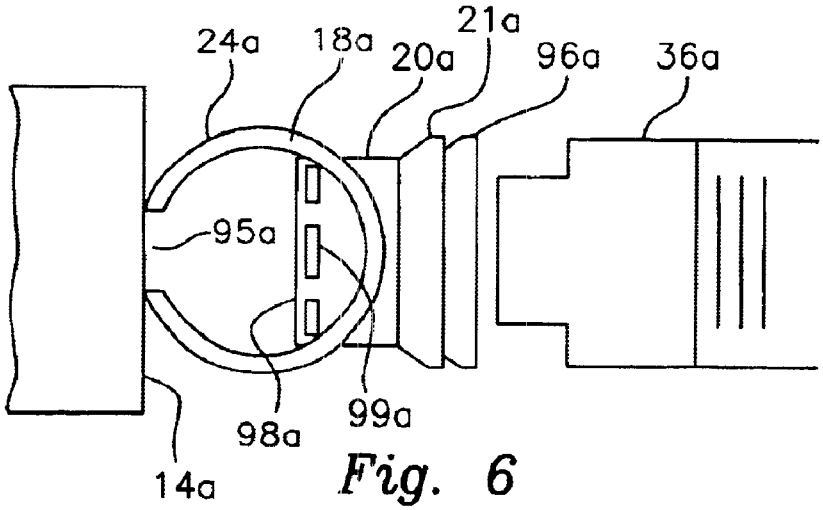
FIG. 6 is an elevational view of the foam core, air passageway and valve shown in FIG. 5.

An alternative preferred air passageway 18*a* and valve 21*a* are depicted in FIGS. 5 and 6. Once again, various numbers and arrangements of these components may be used within the scope of this invention. The following description relates to each such valve. The air passageway includes a very short or abbreviated tubular port 20*a* that is engaged with an opening in the covering (not shown) in a manner much the same as in the prior embodiment. A transverse, generally tubular element 24*a* is attached unitarily to port 20*a*. Once again, the air passageway may comprise a PVC T-pipe or similar component. A longitudinal slot 95*a* is formed in tubular segment 24*a*. This slot abuts and engages the edge of foam component 14*a*. In this version, the baffles employed in the previously described embodiment are eliminated.

Valve 21*a* comprises a standard pressure relief valve such as the boat valve manufactured by Halkey-Roberts. Valve 21*a* is received by and secured within port 20*a* such that the distal end 96*a* of valve 21*a* and an enclosed spring biased air injection needle 97*a* (FIG. 5) are exposed exteriorly of the covering. The inner end 98*a* of valve 21*a* is open. A plurality of orifices 99*a* are formed about the tubular inner end of the valve within passageway 18*a*. As a result, the valve communicates pneumatically with the interior of the passageway and, therefore, with foam core 14*a*.

Air is introduced into and removed from the foam core in a manner analogous to the previously described embodiment. Specifically, the vacuum hose fitting 36*a* is engaged with valve 21*a* such that spring biased air injection needle 97*a* is resiliently opened, which opens valve 21*a*. The vacuum pump is operated to draw air outwardly through the valve from the foam core. If additional valves are used, they remain closed. As a result, the pressure within the foam core is adjusted to provide a viscoelastic or latex foam feel within the support component. When the desired levels of density, pressure relief and firmness are achieved, the vacuum hose fitting 36*a* is disengaged from valve 21*a*. The spring biased air injection needle returns to its normal position, which closes the pressure relief valve 21*a*. As a result, the foam core is maintained in the selected pressure adjusted condition. To fully re-inflate the foam core, the user simply depresses the needle 97*a* to re-open the valve. This permits the foam core to draw air inwardly through the valve and air passageway 18*a* until the core re-inflates. If multiple valves are used, each may be opened to expedite re-inflation. Because the foam core employs a low density foam exhibiting a high level of air flow, the foam re-inflates rather quickly. A conventional cap or closure (not shown) may be attached to the valve when the valve is not in use. In the remaining figures shown herein, the valve is depicted in somewhat simplified form. However, it should be understood that the pressure relief valve shown in FIGS. 5 and 6, as well as other standard pneumatic valves, may be employed in each of the disclosed embodiments and for any and all valves described herein.

Figure 7:
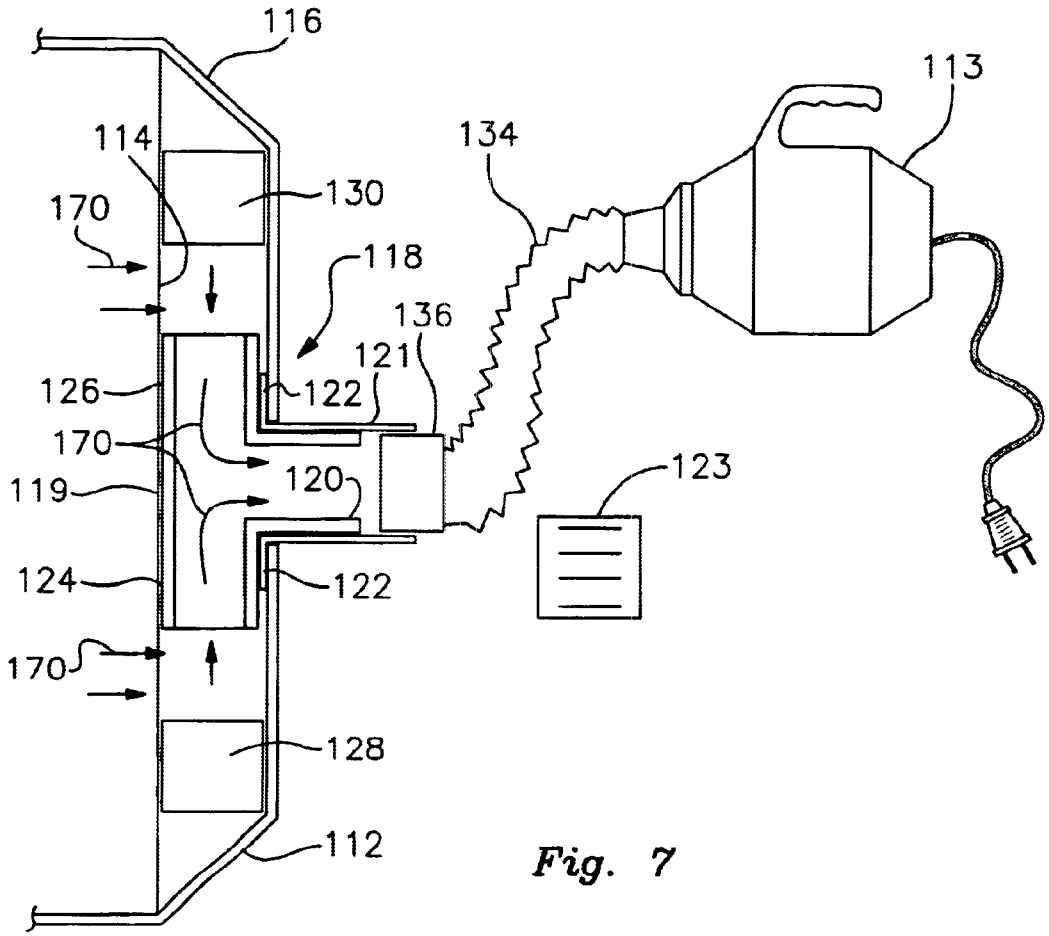
FIG. 7 is a top, partially cross sectional view of the adjustable support apparatus with an external vacuum attached to the air passageway.
Figure 8:
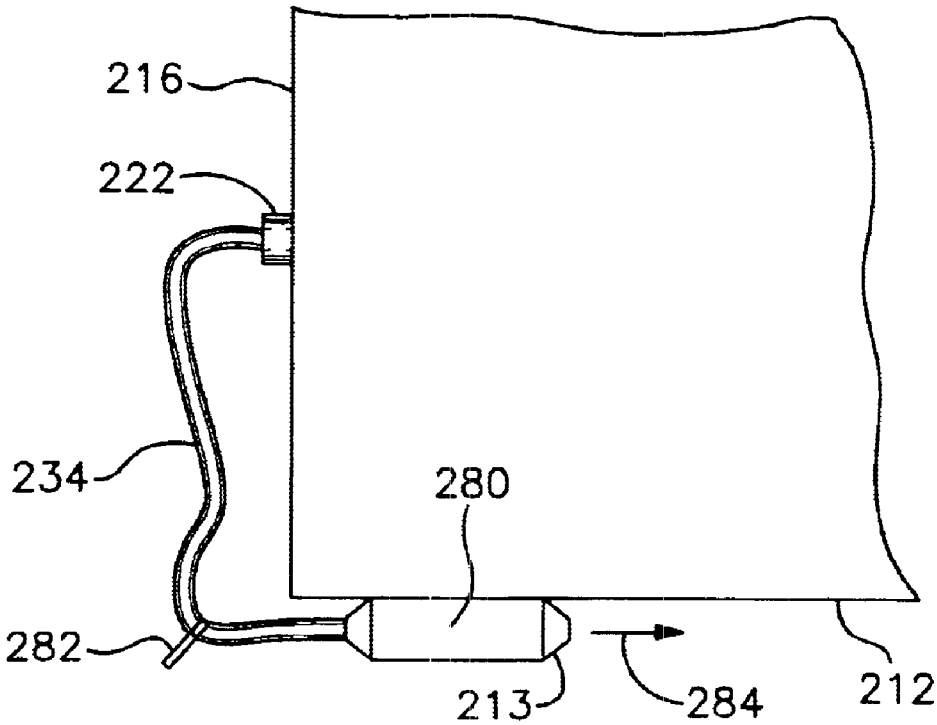
FIG. 8 is a partial plan view of the support structure including a vacuum carried by the support component and permanently and communicably connected to the air passageway.

In the alternative version shown in FIG. 7, foam core 114 is again enclosed by an airtight covering 116. Air passageway 18 comprises a valve 121 that extends through and exteriorly of covering 116. The tubular valve 121 includes a peripheral flange 122 at its inner end. Flange 122 is heat welded to an interior surface of covering 116 such that the valve is permanently secured to the covering. A plastic air passageway comprising a T-pipe apparatus 119 is interengaged with valve 121. T-pipe 119 includes a tubular segment 120 that is inserted through the valve. The T-pipe also includes a second tubular segment 124 that is connected communicably and perpendicularly to segment 120. Segment 120 has an open distal end and segment 124 has opposing distal ends 125, 126 that are open so that the T-pipe provides an air passageway from the open valve into the interior of support component 112.

In this embodiment, a pair of relatively rigid foam blocks 128 and 130 are interposed between the edge of foam block 114 and the end of covering 116. Each block is spaced laterally apart from a respective open end 126 and 126 of T-pipe 119. These blocks serve as baffles and prevent the covering 116 from being sucked into the T-pipe when a vacuum is drawn on the foam core. It should be noted that the passageway shown in FIGS. 5 and 6 may also be used in this version.

In this embodiment, an exterior vacuum pump 113 includes a hose 134 and an end fitting 136 that is received within the opening of valve 121. The distal edge of fitting 136 engages the distal end of tubular segment 120 of T-pipe 119.

Cap 123 selectively and sealably engages and closes valve 121. When the cap is disengaged from the valve, self-inflating foam core 114 draws ambient air inwardly through the valve and T-pipe 119. Such air is absorbed by the foam core, which causes the core to inflate. If cap 123 is then sealably engaged with valve 121, the foam core is maintained in a fully inflated condition and the foam exhibits a low density and relatively high IFD.

To adjust the density of the foam core such that it simulates and feels like a viscoelastic product and pressure relieving system, cap 123 is removed from valve 121 and fitting 136 of vacuum pump 113 is inserted into the open end of the valve. The distal end of fitting 136 engages the distal end of tubular segment 120. Vacuum pump 113 is connected to an appropriate electrical outlet and activated so that air is sucked into the vacuum from foam core 114. Specifically, the air is transmitted, as shown by arrows 170, from the foam core, through the T-pipe and valve, and into vacuum 113. Sufficient air is drawn from the foam core to achieve a simulated viscoelastic effect in the foam core. The cellular structure of the foam is modified (constricted) to produce a high density, low IFD structure. When the desired firmness and support are achieved, fitting 136 is disengaged from valve 121. Cap 123 is sealably replaced onto the valve to close the valve. The selected level of density and firmness are thereby maintained. Alternatively, the user or other person may select a desired level of density, pressure relief and firmness while foam core 114 is self-inflating. During inflation and when the desired firmness and support are reached, fitting 136 is disengaged from valve 121 and cap 123 is sealably replaced onto the valve. The selected level of density and firmness (IFD) are thereby maintained before the core 114 is fully self-inflated and reaches its standard density and IFD level. Once again, in this embodiment, multiple valves may be utilized.

FIGS. 8–11 depict alternative versions of the pressure adjustable foam support featuring different types of vacuum pumps. For example, in FIG. 8, pump 213 is attached by a strap or pouch 280 carried on the side of the covering 216 of support component 212. A hose 234 is permanently connected to a valve 222 which extends outwardly from the support component through covering 216 in the manner similar to that previously described. Once again, valve 222 is in pneumatic communication with the low density polyurethane foam contained within support component 212. Although not shown, this embodiment may also include a T-pipe air passageway and baffles as previously described. A two-way switch valve 282 is disposed within hose 234.

In operation, vacuum pump 213 is operated when needed to deflate the foam core and adjust the air pressure in the core. When the vacuum pump is activated, air is drawn outwardly from the foam core through valve 222 and hose 234. That air is discharged as indicated by arrow 284. During this operation, switch valve 282 is maintained in an open condition so that air passes freely through the hose. When the desired level of density and firmness is achieved in the support component, the vacuum is deactivated and switch 282 is closed so that the level of air pressure that has been obtained in the foam core is maintained during use of the body supporting member 212. If the user needs to re-inflate the foam core or to otherwise add air into the core, he or she simply opens valve 282 so that air is allowed to re-enter the support member 212 through valve 222. That air is absorbed by the self-inflating foam such that density is reduced and firmness is increased.

Figure 9:
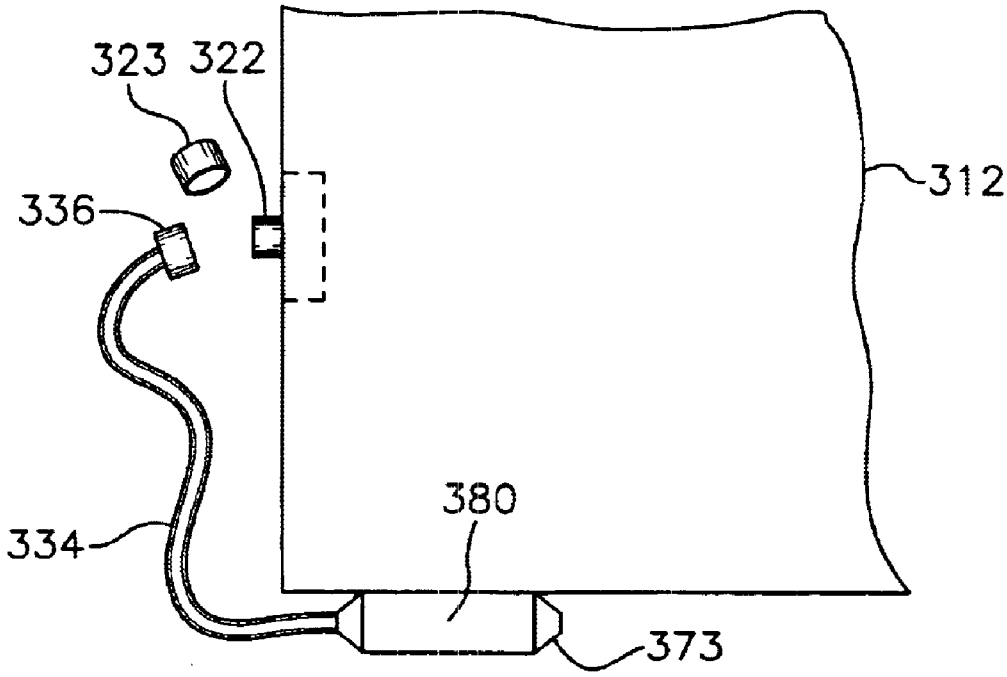
FIG. 9 is a view similar to FIG. 6 but with a vacuum pump attached to the mattress and releasably interengaged with the air passageway.

In FIG. 9, body supporting member 312 is provided with a vacuum 313 that is secured to the body supporting member by a pouch or strap 380 similar to that in the previously described embodiment. In this version, hose 334 is releasably attached to valve 322 in a manner such as described in connection with FIGS. 1–7. Pressure is adjusted within the foam core by selectively engaging the vacuum fitting 336 with valve 322 and activating pump 313. Alternatively, the pump fitting can be disengaged from the valve to allow the self-inflating foam core to draw air inwardly through valve 322. In either case, when the desired pressure level is achieved, cap 323 is re-engaged with valve 322 to maintain the selected degree of density and firmness.

Figure 10:
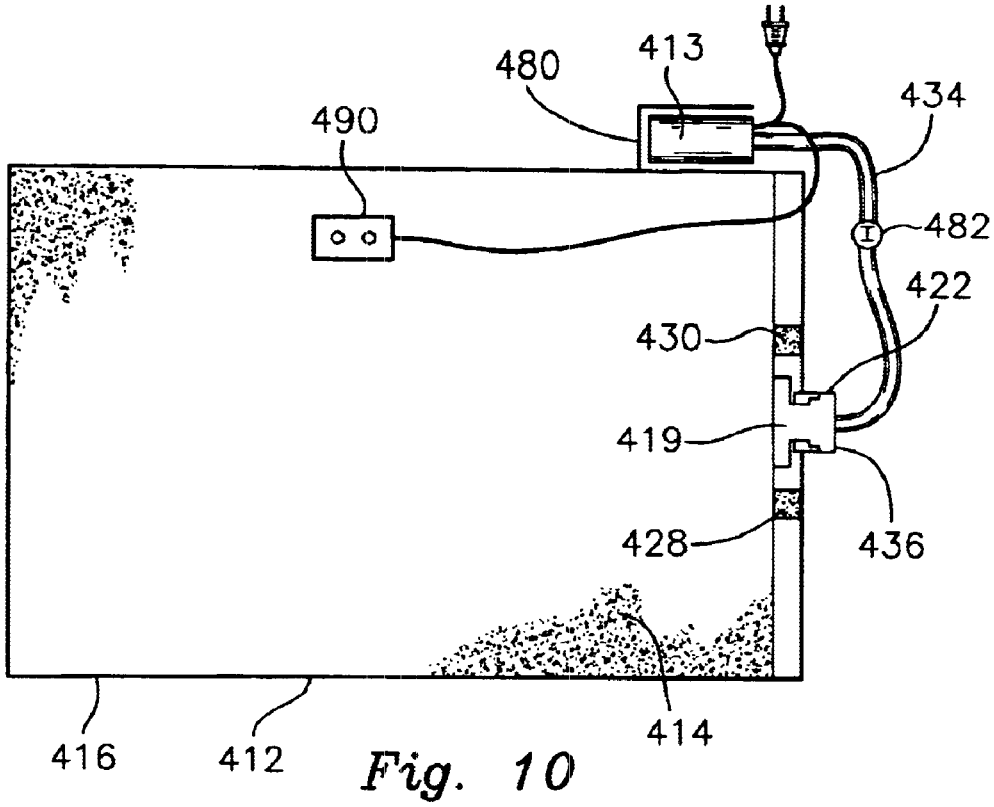
FIG. 10 is a top cross sectional view of the apparatus shown in FIG. 9.

In FIG. 10, support component 412 again includes a covering 416 and an enclosed foam core 414. A vacuum 413 is carried in an external pouch 480 carried by covering 416. A flexible tube 434 is connected to vacuum to 413. Tube 434 carries a fitting 436 that engages a valve 422 extending through and exteriorly of covering 416. As in the prior versions, valve 422 includes an interior flange that is heat welded to the inside surface of the covering. A T-pipe 419 is interengaged with valve 422, again in the manner shown in FIG. 5. Fitting 436 exteriorly engages valve 422 in this version. The fitting may be permanently or releasably attached to the valve. Foam baffle blocks 428 and 430 are disposed between foam core 413 and covering 416 and are spaced apart from the transverse openings of T-pipe 419.

Vacuum pump 413 is connected to an electrical power source and is activated, such as by a remote control module 490 to selectively pump air out of core 414 in the manner previously described. Once again, a two-way valve 482 is disposed in the hose. This valve is open during the vacuum operation and is closed to maintain the foam core at a selected air pressure. Subsequently, valve 482 is opened to re-introduce air into the self-inflating foam when needed.

Figure 11:
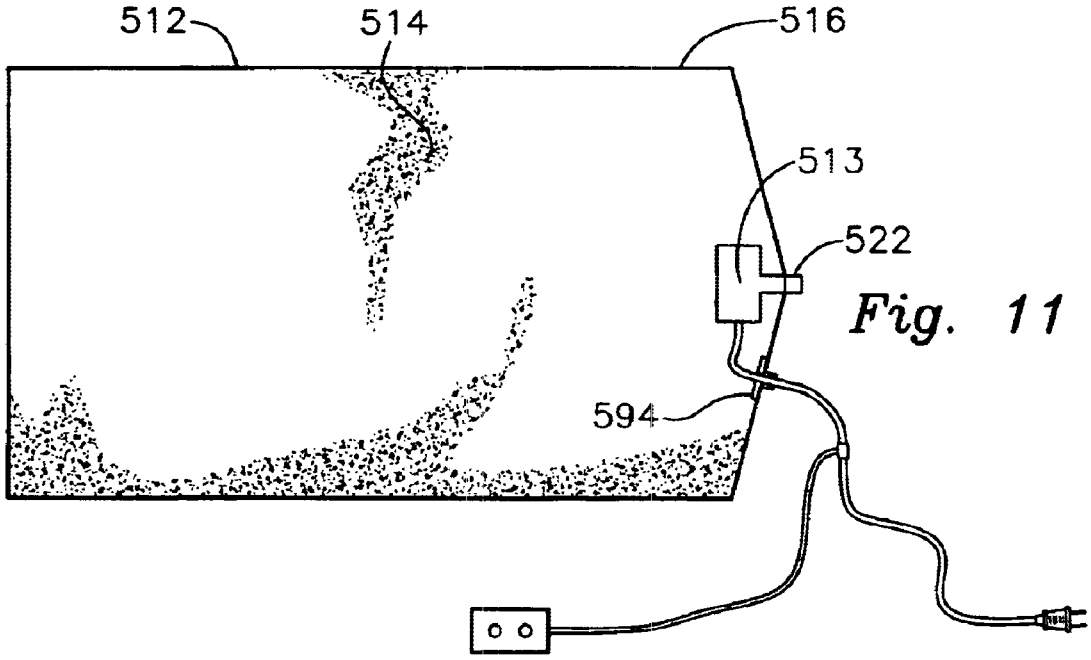
FIG. 11 is a view similar to FIG. 10 but of an alternative embodiment wherein the vacuum pump is disposed internally within the covering of the support component.

In FIG. 11, support component 512 is constructed in a manner similar to the previously described embodiments. In particular, foam core 514 is enclosed within airtight covering 516. In this version, a vacuum 513 is also enclosed within covering 516 at one end of core 514. Vacuum 513 is communicably connected to a valve 522 that extends outwardly through the covering. The valve may be secured to the covering by a flange as previously described, which holds the covering apart from the vacuum. This again prevents the covering from being sucked into the vacuum during operation. An electrical cord and on/off switch are connected to the interior vacuum through an airtight flange 594 formed in covering 516.

When pump 513 is activated, it operates to pump air from core 514 outwardly through attached valve 522. Once again, a cap, not shown, may be employed to sealably close the valve and maintain the selected air pressure within core 514. The pump remains in an off condition when the valve is closed. Subsequently, the valve may be opened to re-introduce air into the self-inflating foam when needed.

Figure 12:
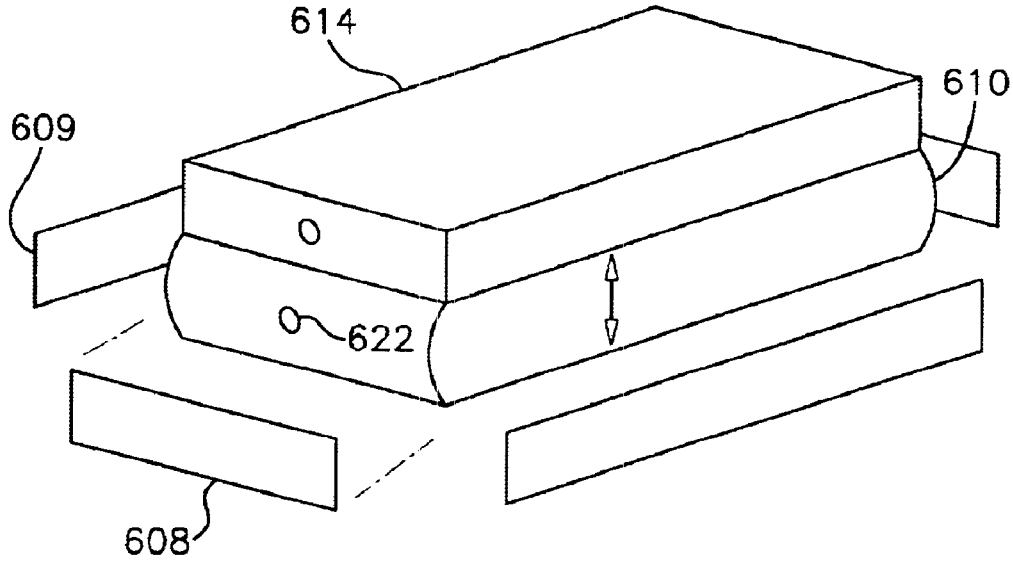
FIG. 12 is a perspective view of a version of the support apparatus employing an inflatable bladder as part of a supporting frame.

As previously stated, the support apparatus of this invention may be used in a wide variety of mattresses, mattress toppers, pads, cushions, mats, etc. When the invention is employed in a mattress, a supporting frame is typically disposed beneath the mattress for the support thereof. This frame may comprise a fixed structure composed of wood, metal, etc. Alternatively, it may comprise an adjustable structure. In certain embodiments, FIG. 12, the supporting frame 608 may include an adjustable air bladder 610 surrounded by elongate frame elements 609. The bladder is provided with its own air inlet/exhaust valve 622, which enables the mattress supporting bladder to be inflated (raised) and deflated (lowered) as required to exhibit a selected height. A pump may blow air into the bladder 610 through valve 622 when inflation is needed. Conversely the pump can be connected to the bladder to evacuate air when the mattress supporting frame needs to be less firm. The bladder may be totally evacuated to be folded, rolled and stored. Adjustable, self-inflating foam mattress 614 operates in a manner analogous to that previously described and includes a valve 6. In this version, the bladder is pressure adjustable for height adjustment only, which contrasts with prior air mattresses wherein the bladder is adjusted for firmness.

Figure 13:
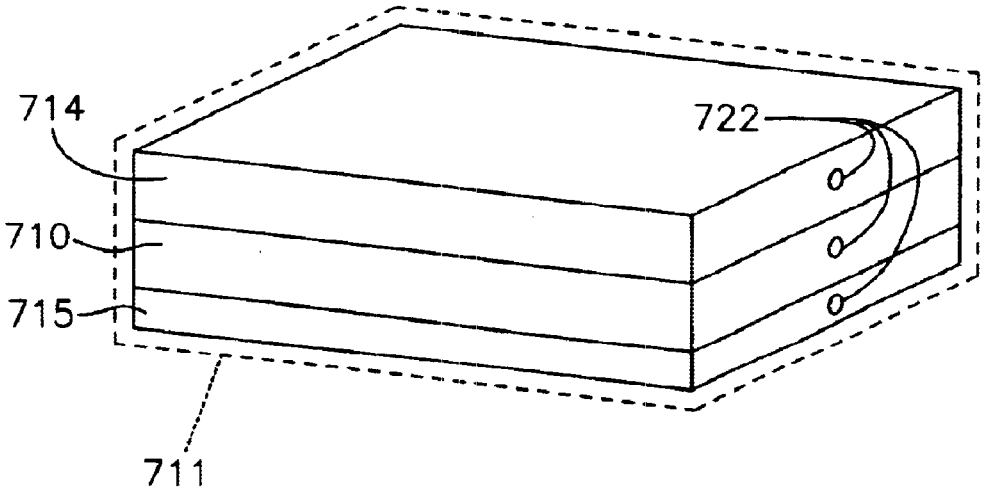
FIG. 13 is a perspective view of a support apparatus wherein an inflatable bladder is disposed between two pieces of foam.

In certain embodiments, FIG. 13, the air bladder may be incorporated within the outer covering 711 and interposed between top and bottom foam layers 714 and 715. Each component includes a respective valve or valves 722. The purpose of the bladder is not for comfort or pressure adjustability as in most other air bladder support systems on the market today. It is used, instead, as a bed frame to raise and support the foam core. The internal air bladder 710 may be viewed as an internal mattress supporting frame. The bottom foam layer 715 may be a firmer IFD. Because of its greater weight, foam 715 acts as a stabilizer. The top foam layer 714 may be pressure adjusted for comfort. Alternatively, the entire unit can be inverted and the firmer IFD of layer 715 may be used. The middle air chamber may be deflated so as to provide a low height mattress or a futon. When the bladder is inflated fully, the height of the entire unit is approximately 24–26". This is the height at which a standard mattress would normally be supported by a bed frame.

The pump may be mounted in various locations. In addition to the locations described above, the pump may be carried in a pouch formed in a mattress cover that is releasably engaged over the support component. The mattress cover may be provided with an opening that communicates with and receives the valve or valves employed in the support structure.

In certain versions of this invention, air pressure may be continuously and alternately added to and removed from selected sections of the foam core. Such a feature is particularly effective in a hospital mattress designed to combat bed sores. The hospital mattress may be constructed largely in the manner shown in FIG. 8. The vacuum pump includes a controller and is connected to an associated solenoid valve designed to selectively open and to introduce air into or remove air from the foam core. The valve is closed otherwise to maintain the core at a selected pressure. A hose is permanently interconnected between the pump and one or more air passageways that pneumatically communicate with the interior of the support component and the foam core therein. The valve shown in FIG. 8 may be eliminated and the hose connected directly and communicably to the interior of the support structure. The movement of the air cycle is extremely slow (i.e. it would normally take several hours to completely deflate the foam core). Every several minutes, the operation alternates. First, the foam self-inflates. Then, the foam deflates due to the vacuum sucking air out of the foam. The respective operations reverse continuously and repeatedly. This continuous adjustment of air within the foam core and the mattress helps to prevent ulcers from forming on the patient's skin. Multiple solenoid valves may also be formed in the mattress. Each valve may be communicably connected with a respective pump (or a single pump) and controlled in a known manner such that different air pressures are exhibited at different locations in the mattress. This continuous pressure adjustability helps to prevent the formation of ulcers and bed sores on the patient's skin.

Figure 14:
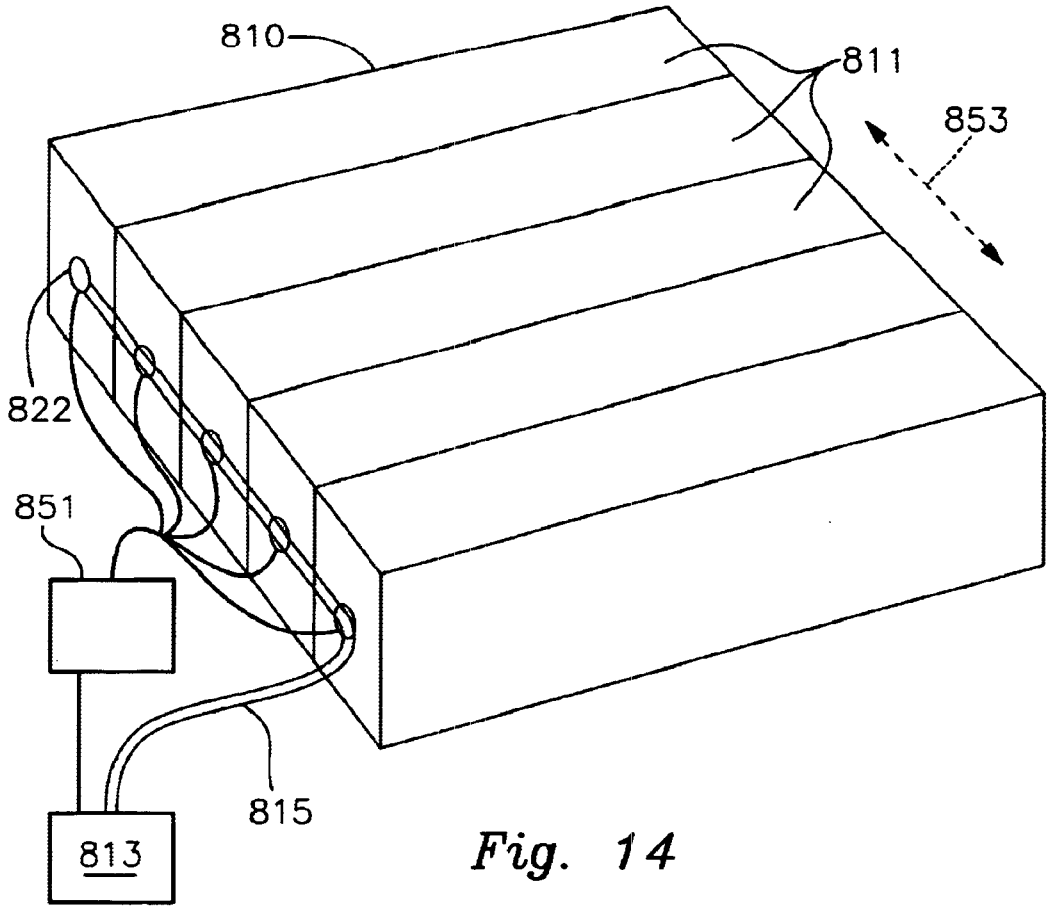
FIG. 14 is a simplified perspective, and partly schematic view of a support apparatus employing multiple lateral foam segments that are alternately and sequentially inflated and deflated to continuously vary firmness and support.

As shown in FIG. 14, a mattress or other support 810 may include a plurality of transverse foam sections 811, which are either contiguous or separated by plastic partitions in the manner previously described. Each transverse foam section 811 is communicably interconnected to a respective solenoid valve 822, which typically extends through a covering (not shown) that encloses the entire mattress 810. A vacuum pump 813 and a hose 815 are communicably joined to the valves 822. A microprocessor or other known type of controller 851, which may be installed in pump 813, controls the operation of the pump and the solenoid valves so that the foam segments 811 are sequentially and alternately self-inflated and deflated to provide varying support along the length of mattress 810. In particular, a respective valve may be open with the vacuum operably engaged to deflate the foam, open with the vacuum operably disengaged to self-inflate the foam, and closed to maintain the foam at a selected pressure. The firmness of the mattress may be thereby adjusted back and forth along the mattress in a continuous manner as indicated by double headed arrow 853.

In the version of the pressure adjustable support shown in FIG. 15, mattress 910 again includes a plurality of foam segments 911, which extend transversely. It should be noted that other arrangements of partitioned foam segments (e.g. longitudinal segments) may be utilized. In any event, in this version, a plastic partition 909 is formed between each adjoining foam segment 911. In other embodiments, the adjoining foam segments may be interconnected contiguously or along a narrow plastic strip. The upper surface of each segment 911 has a convex or rounded shape so that direct contact of the mattress with the user's body is minimized. The upper convex portion may be formed unitarily with the remainder of the foam sections or, alternatively, may constitute a separate piece of foam, e.g. piece 915, which has a different density and IFD than underlying portion 916.

Pump 913 is communicably connected to each foam segment 911 by means of a respective valve or valves 922, analogous to those previously described. In operation, pump 913 is operated by a controller or otherwise so that the foam segments 911 are sequentially and alternately inflated and deflated selected amounts. Inflation and deflation is indicated by doubleheaded arrows 919. Sequential pressure adjustment along the adjacent foam segments is depicted by double headed arrow 953. In this manner, the pressure is continuously adjusted so that all parts of the patient's body experience continuously changing engagement pressure with the underlying mattress. This minimizes the formation of bed sores. This is particularly helpful for use with geriatric patients or other persons being confined to bed for an extended period of time. For example, as shown in FIG. 15A, segment 911*a* is deflated by vacuum 913 so that it does not touch user B; rather a space S is formed between segment 911*a* and the user's body. This helps to avoid the formation of skin ulcers.

Figure 15B:
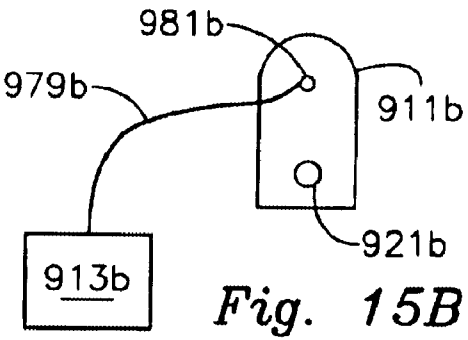
FIG. 15B is a schematic view of a representative foam segment having two air valves.

As shown schematically in FIG. 15B, each of the foam segments (represented by segment 911*b*) may include a pair of lower and upper valves 921*b* and 981*b* respectively. The lower valve is provided for initial inflation (and final deflation) of the foam segment in a manner analogous to that previously described. In addition, a second upper valve 981*b* is connected to vacuum pump 915*b*, such as through a hose 979*b*. This structure enables the foam segment 911*b* to be pressure adjusted by the vacuum and/or through self-inflation of the foam piece in the manner previously described. Once again, each of the foam segments 911*b* may comprise a single piece or separate pieces having respective densities and indentation force deflection values.

Figure 15C:
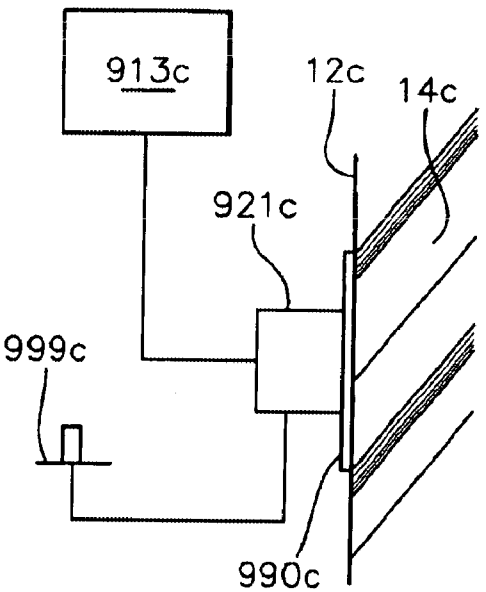
FIG. 15C is a schematic, partially cross sectional view of a version of the support utilizing a solenoid valve that is open either automatically for communicating with a vacuum to deflate the foam core, or manually for self-inflating the core.
Figure 15:
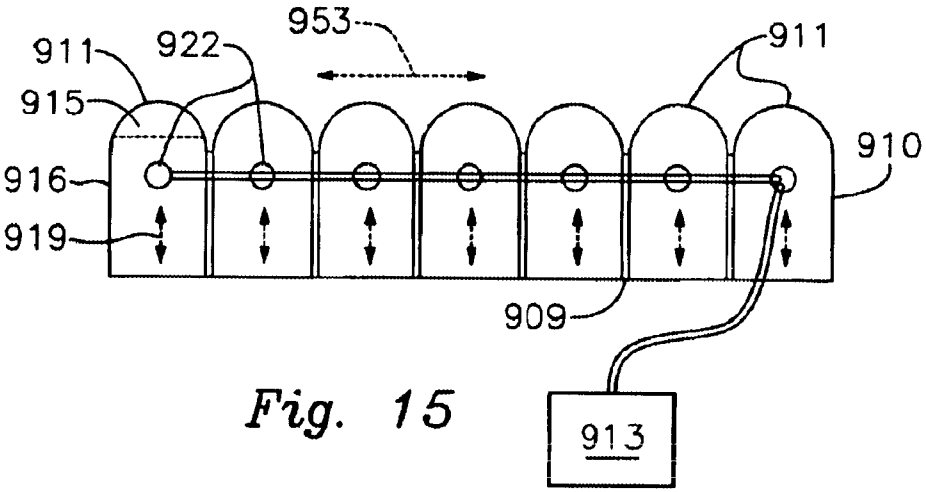
FIG. 15 is a simplified, elevational side and partly schematic view of a support apparatus similar to that of FIG. 14 and wherein convex upper surfaces are employed in each foam segment.
Figure 15A:
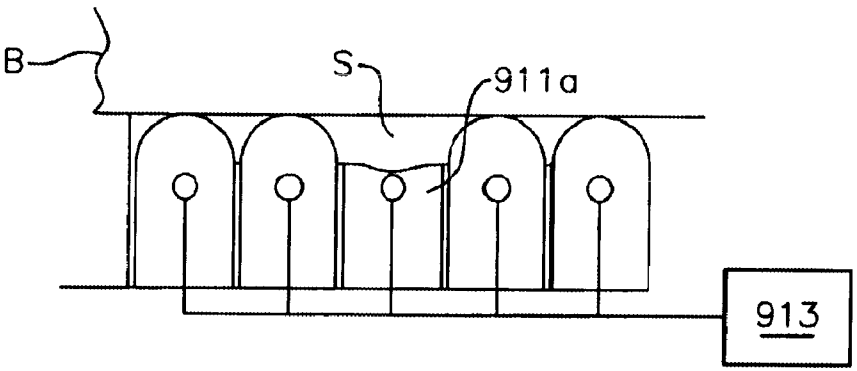
FIG. 15A is a schematic view of the support of FIG. 15 with one of the foam pieces in a partially collapsed condition.

There is shown in FIG. 15C, still another embodiment wherein vacuum 913*c* is connected to a solenoid valve 921*c*. The valve is, in turn, communicably connected to the interior of support structure 12*c* through an exterior grommet 990*c*. A self-inflatable foam core 14*c* may be pressure adjusted in a manner analogous to that previously described. In particular, the air pressure and volume within the foam core are decreased when the solenoid valve 921*c* is opened (such as by a controller, not shown) and vacuum 913*c* is operated. With the valve still open, the vacuum may be shut-off to allow the foam core to re-inflate to a selected level. The valve may be closed automatically at any point to maintain the foam at a selected level of density and firmness. The user may manually open valve 921*c* and thereby re-inflate foam core 14*c* by manually operating a switch 999*c*. This allows air to re-enter the support structure 12*c* and foam core 14*c* through the open valve 921*c*. By releasing switch 999*c*, the user re-closes the solenoid valve 921*c* so that the selected pressure within the foam core is maintained. In a similar manner, in cases where the vacuum 913*c* has drawn air out of foam core 14*c* to achieve a desired level of density and firmness, the solenoid valve may be closed automatically by the controller to maintain the foam core in a selected state of density and firmness. This allows the user to conveniently achieve a unique and individually customized degree of comfort and support.

Figure 16:
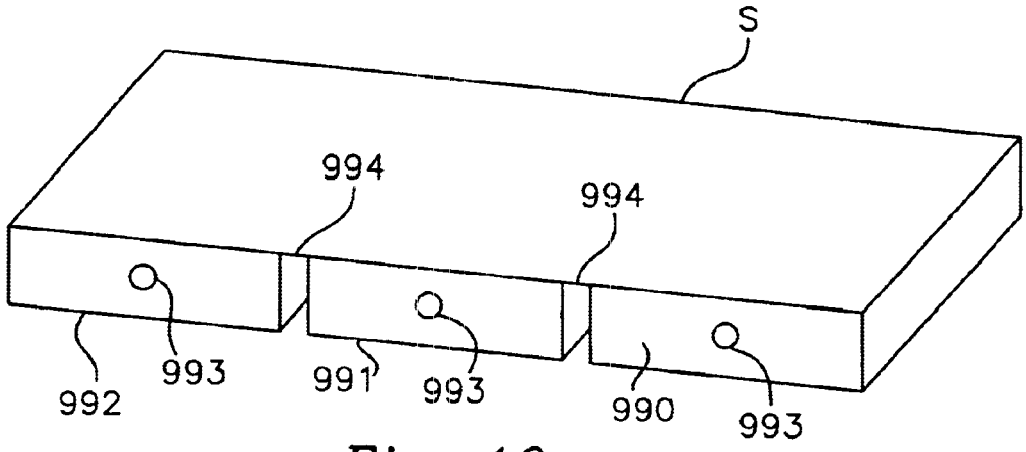
FIG. 16 is a perspective view of a support structure utilizing multiple foldably connected sections.

In the embodiment shown in FIG. 16, support S includes three discrete sections 990, 991 and 992, which correspond to the foot, torso and head areas of the patient. Each of the segments comprises one or more foam pieces as previously described. Each of the segments 990, 991 and 992 is again fitted with one or more valves 993, which permit each of the support sections to be individually pressure adjusted as required.

Each of the sections 990, 991 and 992 is interconnected to the adjacent section or sections by a thin plastic strip 994. This strip may comprise the material that similarly constitute the cover. Strips 994 allow the respective sections 990, 991 and 992 to fold conveniently relative to one another so that the support S may be stored and transported in a quick and convenient manner. Collapsibility is important so that the apparatus does not exceed size and weight limitations dictated by standard ground transportation companies such as FedEx and UPS.

The individual sections may be interconnected permanently or releasably. Various types of fasteners (e.g. zippers, Velcro™ and snaps) may be utilized in releasably connected versions.

It should be understood various other arrangements may be employed within the scope of this invention which include one or more of the features from the respective embodiments shown herein. In certain versions or each of the foregoing examples, multiple valves may be utilized. In all versions, it is important that the support component be pressure adjustable in accordance with the teaching of this invention so that the foam core feels like a viscoelastic slow recovery foam. This is achieved with much less expense and using a much lighter weight, low density foam. Furthermore, the foam employed in the present invention is adjustable unlike standard viscoelastic foam so that individually desired levels of firmness, comfort and support may be achieved.

Various types of pumps may be employed within the scope of this invention. These include all types of vacuum pumps, AC pumps, hand pumps and DC pumps. Reversible pumps may be used for the air bladder.

From the foregoing it may be seen that the apparatus of this invention provides for a pressure adjustable foam support apparatus and to a method of producing a body supporting structure with adjustable levels of density, pressure relief and firmness simulating those of viscoelastic or latex foam. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A pressure adjustable foam support apparatus comprising:

a resilient, self-inflating open-cell foam core having incrementally adjustable levels of density and IFD, which core is alternatable between an atmospheric pressure in a fully inflated state and a sub-atmospheric pressure in a partially inflated state;

a flexible airtight covering that encloses said core;

at least one air passageway formed through said covering in pneumatic communication with said foam core, which passageway carries a valve for alternately permitting and blocking passage of air into and out of said core through said passageway, said valve being opened for exhausting air from and at least partially deflating said core and for allowing a core that is at least partially deflated to draw in air through said passageway and self-inflate, said valve being selectively closed with said core in one of a plurality of fully and partially inflated states for maintaining a selected air pressure and a corresponding density and IFD level within said core, at least one such level of density and IFD in a partially inflated state providing said core with a viscoelastic or latex foam feel; and a vacuum pump communicably engagable with said passageway through said valve and operable for exhausting air incrementally from said core through said passageway and constricting the cellular structure of the foam to provide said core with a selected sub-atmospheric pressure wherein said core has a greater density and a lesser IFD than in its fully inflated state.

2. The apparatus of claim 1 in which said core includes an original cellular structure at atmospheric pressure and a modified cellular structure at sub-atmospheric pressure.

3. The apparatus of claim 1 in which said passageway includes a first pipe portion disposed within said covering and a second pipe portion attached communicably and extending transversely to said first pipe portion, said second pipe portion extending through and being pneumatically communicable with air exteriorly of said covering.

4. The apparatus of claim 1 further including a baffle disposed adjacent said passageway Intermediate said foam core and said covering to restrict said covering from being sucked into said passageway by operation of said pump.

5. The apparatus of claim 1 in which said pump is attached to said passageway interiorly of said covering.

6. The apparatus of claim 1 in which the air pressure in said core is adjustable such that said core includes density of at least 3 lbs/ft$^3$ and an indentation deflection force of less than 15.

7. The apparatus of claim 1 further including a selectively inflatable and deflatable air bladder juxtaposed beneath and supporting said foam core for adjusting the height thereof.

8. The apparatus of claim 1 in which said foam core has a density of 1–2.5 pounds per cubic foot and an indentation force deflection of 18–65 in a fully inflated state.

9. The apparatus of claim 8, in which the air pressure in said core is adjustable such that said core includes density of at least 3 lbs/ft$^3$ and an indentation force deflection of less than 15.

10. The apparatus of claim 1 in which said foam core includes multiple, discrete foam pieces within said covering.

11. The apparatus of claim 10 further including at least one partition formed in said covering and defining a plurality of compartments therein, each compartment accommodating at least one of said foam pieces, each compartment further having at least one said passageway and a respective said valve in pneumatic communication therewith and with each said foam piece in said compartment.

12. The apparatus of claim 10 in which said foam pieces have multiple respective densities and indentation force deflections.

13. The apparatus of claim 10 in which said multiple foam pieces include respective elongate pieces juxtaposed longitudinally within said covering.

14. The apparatus of claim 10 in which said foam pieces are juxtaposed laterally within said covering.

15. The apparatus of claim 10 in which said foam pieces are arranged in substantially planar layers within said covering.

16. A pressure adjustable foam support apparatus comprising:

a resilient, self-inflating open-cell foam core having incrementally adjustable levels of density and IFD, which core is alternatable between an atmospheric pressure in a fully inflated state and a sub-atmospheric pressure in a partially inflated state;

a flexible airtight covering that encloses said core;

at least one air passageway formed through said covering in pneumatic communication with said foam core, which passageway carries a valve for alternately permitting and blocking passage of air into and out of said core through said passageway, said valve being opened for exhausting air from and at least partially deflating said core and for allowing a core that is at least partially deflated to draw in air through said passageway and self-inflate, said valve being selectively closed with said core in one of a plurality of fully and partially inflated states for maintaining a selected air pressure and a corresponding density and IFD level within said core, at least one such level of density and IFD in a partially inflated state providing said core with a viscoelastic or latex foam feel; and a vacuum pump communicably engagable with said passageway through said valve and operable for exhausting air incrementally from said core through said passageway and constricting the cellar structure of the foam to provide said core with a selected sub-atmospheric pressure wherein said core has a greater density and a lesser IFD than in its fully inflated state;

said covering and said core having a length and a width that are large enough for supporting the entire body weight of an average adult person in a prone position thereon;

said core having a thickness of at least 6 inches whereby said core remains substantially fully inflated when supporting the body weight an average adult person, even with said valve in an open condition.

17. A pressure adjustable and modulable foam support apparatus in the general shape and size of a bedroom mattress comprising:

a resilient open cell foam core that is density and IFD adjustable;

a flexible airtight coveringing that encloses said core;

at least one air passageway formed through said covering in pneumatic communication with the interior of said foam core, which passageway contains a valve; and a vacuum communicably connected to said valve outside of said covering; said valve being opened for allowing air to pass to and from the core when the vacuum is deactivated and activated respectively;

said vacuum being activated for exhausting air from said foam core in a selected quantity to constrict and partially deflate the foam cells within said core and being deactivated for allowing a core that is at least partially collapsed to draw air in through said passageway and inflate, said valve being selectively closed with said foam core in one of a plurality of fully self inflated and partially deflated states to maintain a desired atmospheric or sub-atmospheric air pressure within the core, whereby corresponding levels of density and IFD are selectively exhibited within said core, at least one such level in a partially collapsed state providing said core with a viscoelastic or latex foam feel.

18. The apparatus of claim 17 wherein said covering and said core have a length and a width that are large enough for supporting the entire body weight of one or two adult persons in a prone position thereon; said core having a thickness of at least 6 inches whereby said core remains substantially fully inflated and exhibits substantially atmospheric pressure within when supporting the body weight of one or two adult persons, even with said valve in an open position and the vacuum deactivated.

* * * * *